US006954053B2

(12) United States Patent
Gay

(10) Patent No.: US 6,954,053 B2
(45) Date of Patent: Oct. 11, 2005

(54) INTERFACE FOR SHUNT VOLTAGE REGULATOR IN A CONTACTLESS SMARTCARD

(75) Inventor: Michael J. Gay, Vaud (CH)

(73) Assignee: Atmel Corporation, San Jose, CA (US)

( * ) Notice: Subject to any disclaimer, the term of this patent is extended or adjusted under 35 U.S.C. 154(b) by 261 days.

(21) Appl. No.: 10/413,077

(22) Filed: Apr. 14, 2003

(65) Prior Publication Data

US 2004/0008013 A1 Jan. 15, 2004

Related U.S. Application Data

(60) Provisional application No. 60/395,118, filed on Jul. 10, 2002.

(51) Int. Cl.[7] ..... G05F 1/44; G05F 1/613

(52) U.S. Cl. ..... 323/273; 323/223

(58) Field of Search ..... 323/273, 272, 323/266, 220, 223, 232; 363/16, 24, 127

(56) References Cited

U.S. PATENT DOCUMENTS

| | | | | |
|---|---|---|---|---|
| 4,103,219 A | | 7/1978 | Wheatleyh, Jr. | 323/8 |
| 5,045,770 A | | 9/1991 | Brooks | 323/223 |
| 5,396,538 A | | 3/1995 | Hong | 379/58 |
| 5,430,366 A | * | 7/1995 | Erckert et al. | 323/282 |
| 5,874,829 A | * | 2/1999 | Holweg et al. | 323/274 |
| 6,134,130 A | * | 10/2000 | Connell et al. | 363/89 |
| 6,636,146 B1 | * | 10/2003 | Wehoski | 340/10.4 |
| 6,705,441 B1 | * | 3/2004 | Boys et al. | 191/10 |

FOREIGN PATENT DOCUMENTS

| | | |
|---|---|---|
| EP | 0 398 943 | 12/1995 |

* cited by examiner

*Primary Examiner*—Rajnikant B. Patel
(74) *Attorney, Agent, or Firm*—Thomas Schneck

(57) ABSTRACT

The present invention provides shunt voltage regulation by employing a rectifying means to rectify an incoming signal and a current sinking means to divert current from the output of the rectifying means in such a way that the output voltage is maintained at an appropriate level and the modulation level does not rise above the acceptable range. This is accomplished by having two feedback mechanisms for the control of said current sinking means. A first feedback mechanism utilizes a voltage dividing means to generate a control voltage signal that will cause the average output voltage of the rectifying means to be equal to the a reference voltage. A second feedback mechanism utilizes non-linear processing means and capacitors to transmit part of the modulation frequency to the control of the current sinking means, thereby keeping the modulation at the output of the rectifying mean at an appropriate level at all time.

6 Claims, 5 Drawing Sheets

INTERFACE FOR SHUNT VOLTAGE REGULATOR IN A CONTACTLESS SMARTCARD

CROSS-REFERENCE TO RELATED APPLICATION

This application claims priority from U.S. provisional application No. 60/395,118, filed Jul. 10, 2002.

FIELD OF INVENTION

The present invention relates to voltage regulators. In particular, the present invention relates to voltage regulators used in contactless Smart (IC) card media wherein electrical power and electronic information is transferred through inductive means.

BACKGROUND ART

Contactless smartcards receive both electrical power and data from a modulated high frequency electromagnetic signal emitted by a card reader via an inductively coupled coil on the card. The electromagnetic field strength of the signal and hence the voltage and current generated within the smartcard, depends on the distance of the smartcard from the reader. Therefore, if the coil and associated circuit is designed to adequately energize the card at a specified maximum working distance, it will generate much higher voltage and current as the smartcard is moved closer to the reader that serves as the signal source.

A voltage regulator is used to protect the electronic circuits in such smartcards from being damaged by excessive voltage. Shunt voltage regulators maintain a steady voltage output by sinking excess current from the input. In the shunt arrangement, no part of electronic circuit receives a high input voltage and therefore this form of voltage regulator is desirable. However, shunt regulators also tend to maintain the supply voltage at a level independent of the coil current and thus would remove any data carried by the relatively small amplitude modulation of the high frequency current. A shunt regulator that acts to control the mean supply voltage without at the same time suppressing the modulation component is therefore desired.

FIG. 1 shows a prior art shunt voltage regulator. Inductor coil L connects to a full wave rectifier that is made up of diodes D1, D2, D3 and D4. The inductor coil is tuned by a first capacitor C1. The output O of the full wave rectifier is connected to a load resistor R1 and a reservoir capacitor C2. The output O of the full wave rectifier is further connected to the drain of a NMOS transistor M that functions as a current sink. The gate of the NMOS transistor M is connected to the output of a voltage comparator COM through a low-pass filter LPF. The voltage comparator COM has an inverting input and a non-inverting input. The inverting input is connected to a reference voltage Vref while the non-inverting input is connected to the output O of the full wave amplifier. The comparator COM, the filter LPF and the MOS device M form a negative feedback loop that matches the rectifier output voltage to the reference voltage Vref. The filter LPF functions to prevent high frequency modulation, which carries data, from reaching the MOS device M so that the data is not removed from the output.

Although the shunt regulator shown in FIG. 1 provides adequate voltage protection to circuits in the smartcard, there are several disadvantages associated with this design. A first disadvantage of this circuit is that the transconductance of the MOS device M varies widely according to the current it is called upon to pass and hence the feedback loop characteristics can vary widely. A second disadvantage is that the rectifier circuit supplies current only during that phase of the energizing signal when the input voltage exceeds the sum of rectifier output voltage and the voltage drop across a pair of diodes. When the rectifier is not passing current, the MOS device M draws current from the reservoir capacitor C2, thereby producing a large ripple voltage on the output line. A third disadvantage is that because the MOS device M tends to act as a current sink, it presents a low dynamic conductance across the output. A consequence is that small variations in the received energy due to the modulation tend to produce exaggerated variations in the output voltage. A fourth disadvantage is that the transistor current returns to the coil via either diode D1 or D2. The coil terminal connected to the conducting diode of this pair will develop a voltage that is negative with respect the circuit's negative supply line by an amount equal to the diode voltage drop. This will tend to engender conduction in parasitic devices.

The prior art circuit show in FIG. 2 overcomes some of the disadvantages inherent in the FIG. 1 circuit by relocating the MOS device M directly across the coil. In this configuration, the MOS device M would not draw current from the reservoir capacitor C2 and so the circuit generates much less supply line ripple. Furthermore, the MOS current does not flow through the diodes and so negative excursions of the coil terminals with respect to the circuit's negative supply are avoided.

However, the disadvantage of having variable loop dynamics remains, and so does the tendency of the circuit to produce exaggerated modulation voltages due to the MOS device acting as a current sink. It would be desirable to have a voltage regulator circuit that can overcome the above-cited disadvantages.

An object of the present invention is to provide a voltage regulator circuit suitable for contactless smartcards that are inductively coupled to receive a high frequency energizing and data transmitting signal of variable power.

Another object of the invention is to provide a voltage regulator circuit that produces a regulated average supply voltage carrying an accurate image of amplitude modulated data contained in the high frequency input signal.

DISCLOSURE OF THE INVENTION

The objects are achieved by a shunt voltage regulator that uses multiple feedback paths to control the shunt device. One feedback path utilizes a voltage dividing means coupled to a capacitor and a controlling input of a shunt device through a transconductor. Another feedback path incorporates a non-linear processing means that receives a first input from the voltage dividing means, a second input from a voltage reference and a third input from the transconductor. The output of the non-linear processor connects to the controlling input of the shunt device through a second capacitor and it provides a proper proportionality between the modulation and the mean voltage of the incoming signal.

The nonlinear processing means comprises a balanced amplifier that is responsive to the difference between an input voltage provided by the voltage dividing means and the reference voltage. The output of the amplifier is connected to a resistive element, said arrangement provides a voltage gain that varies according to the square root of the current in the shunt path and thus tracks the transconductance of the shunting device.

BEST MODE FOR CARRYING OUT THE INVENTION

Figure 2:
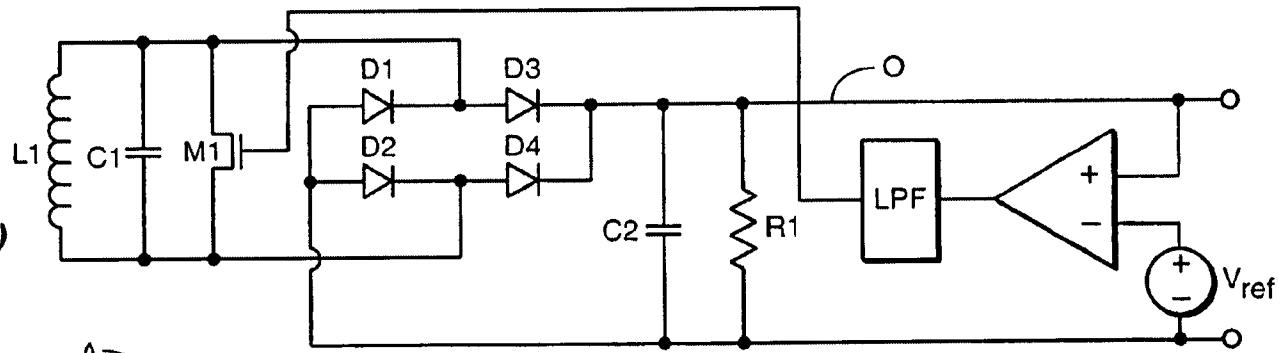
FIG. 2 (PRIOR ART)
FIG. 2 is a schematic of an improved shunt voltage regulator of the prior art.
Figure 3:
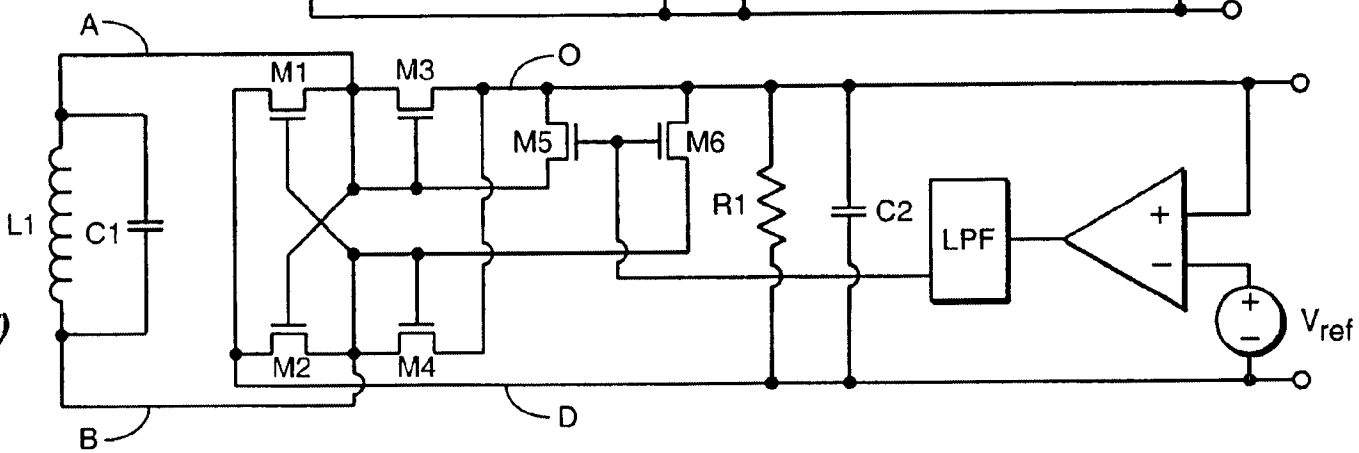
FIG. 3 (PRIOR ART)
FIG. 3 is a schematic of a further improved shunt voltage regulator of the prior art.
Figure 4:
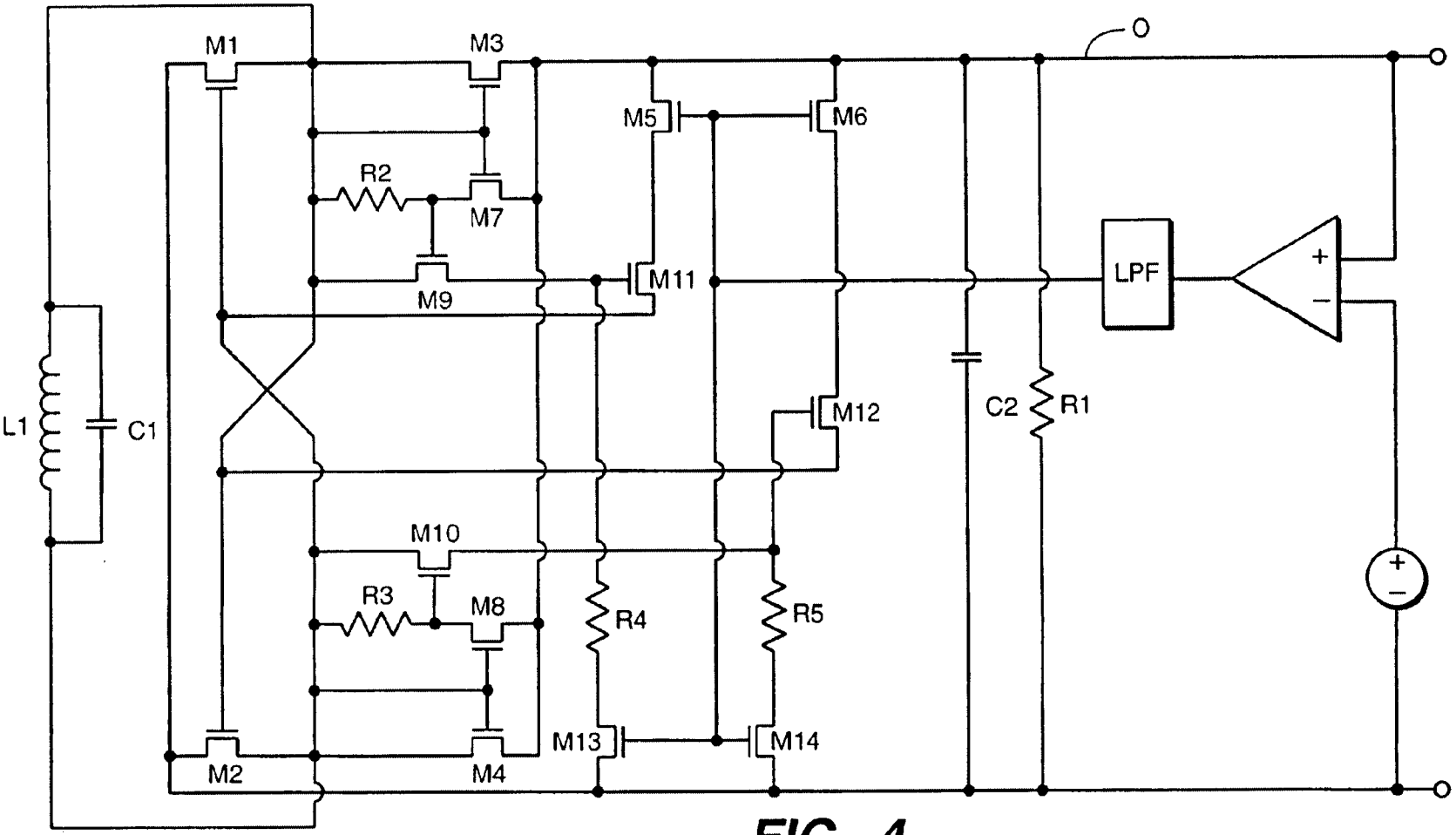
FIG. 4 (PRIOR ART)
FIG. 4 is a schematic of a yet further improved shunt voltage regulator of the prior art.

FIG. 3 shows a known method for implementing a full wave rectifier in MOS technology and for diverting the shunt regulator current from the rectifying path to the negative supply line. (FIGS. 3 and 4 represent essential background for understanding the structure and operation of the improved circuitry of the present invention shown in FIGS. 5–7). MOS transistor devices M1, M2, M3, and M4 replace diodes D1, D2, D3, and D4 of FIGS. 1 and 2. In the circuit, transistors M1 and M2 act as switches, while transistors M3 and M4 are diode connected and have their drains connected to their gates. Transistor M1 is active during the half cycle in which input B is positive, such that M4 conducts. Transistor M2 is active during the half cycle in which input A is positive such that M3 conducts.

Figure 1:
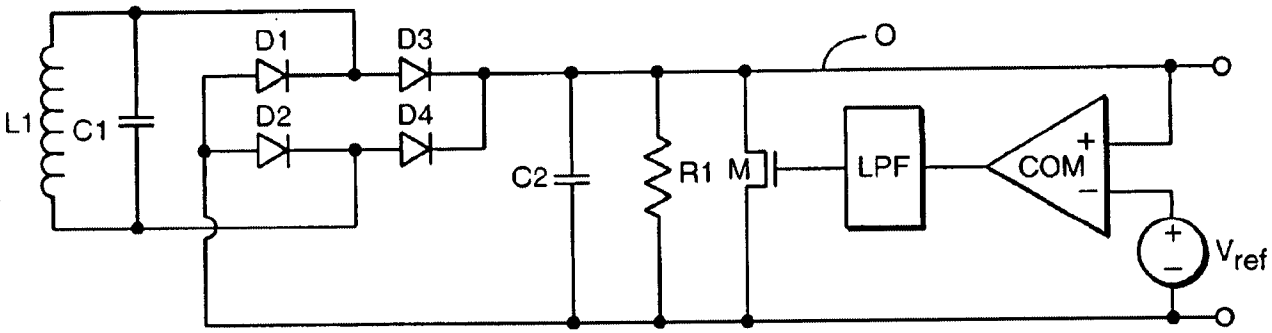
FIG. 1 (PRIOR ART)
FIG. 1 is a schematic of a shunt voltage regulator of the prior art.

The pair of MOS devices M5 and M6 replace the single shunt transistor M of FIGS. 1 and 2. Transistors M5 and M6 have their gates connected in common to a control voltage output line from the low-pass filter LPF. Their drains are connected to the output O from the full wave rectifier (forming the positive supply line of the regulator circuit) and their sources are connected to input A and input B, respectively. Devices M5 and M6 function as current sinking means that diverts current from the output O. M5 is active while input A is negative and M6 is active while input B is negative. The current passing through either one of the MOS devices returns directly to the coil, bypassing the transistors M1 and M2. The voltage drop across M1 and M2 is thereby minimized.

However, the shunt devices M5 and M6 still tend to conduct current during almost the whole of alternated half cycles of the incoming signal and thus generating large supply line ripples at the output O of the rectifier. These ripples can be minimized by limiting the current conduction period of transistors M5 and M6 to the conduction period of the corresponding diode-connected devices M3 and M4. FIG. 4 illustrate how it can be done. In FIG. 4, MOS devices M11 and M12 are connected to the sources of transistors M5 and M6 respectively. Their function is to limit the current conduction period of transistors M5 and M6. In particular, transistors M5 and M6 can conduct only when the corresponding series device M11 or M12 also conducts. MOS device M7, being connected to receive the same gate-source voltage as M3, will conduct during the same period, thereby developing a voltage across R2, which brings M9 and M11 into conduction. Likewise, M8 is connected to receive the same gate-source voltage as M4 and it will conduct during the same period, thereby developing a voltage across R3, which brings M10 and M12 into conduction. When M9 ceases conduction, M13 and R4 sink the current and turn M11 off. Alternatively, when M10 ceases to conduct, M14 and R5 sink current and turn M12 off.

Since the shunt paths that are made up of M5, M11, M6 and M12 function as current sinks, the current they pass is responsive to the output voltage of the low-pass filter LPF and not to the positive supply voltage at output O. A consequence is that modulation of the energizing signal at data rates tends to produce an excessive variation of supply voltage on output O. For example, suppose a card that requires a supply current of 2 mA is placed in a field that induces a 10 mA average current in the coil L. The regulator would adapt to absorb 8 mA. Since the ISO specification calls for the field to be modulated by ±10% to transmit data, the current at the coil would be modulated by ±1 mA. As the regulator is designed to be unresponsive to variation occurring at the data rate, the ±1 mA modulation would be unaffected by the shunt path and thus the ±1 mA modulation at the coil represents a ±50% modulation of supply current at C. Such modulation is considerably higher than the desired level of ±10%. This problem could be further exasperated when the card is placed closer to the source of electric field, where the induced current might reaches 100 mA and carries a modulation component of ±10 mA.

Figure 5:
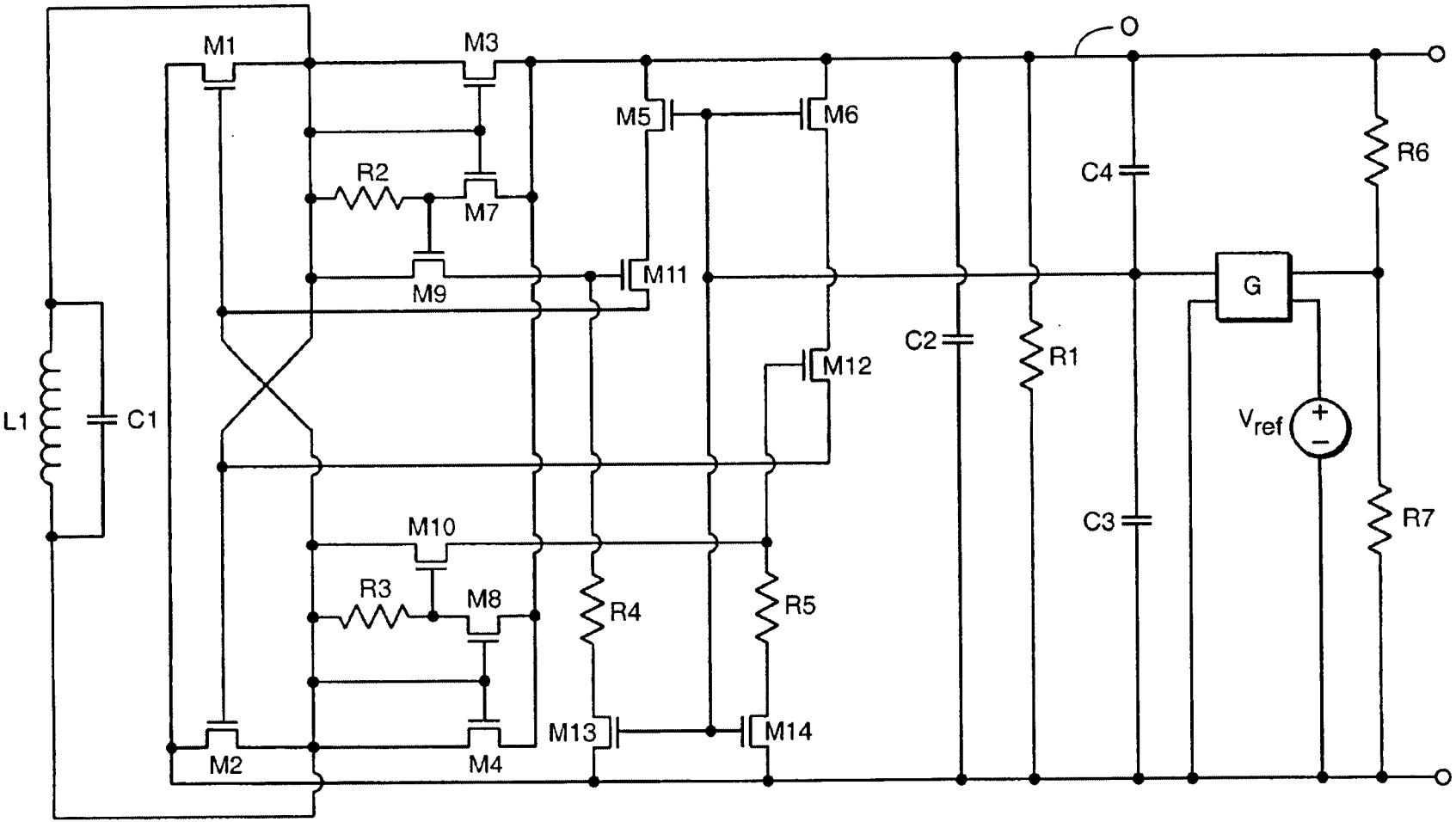
FIG. 5 is a schematic of a shunt voltage regulator of the present invention.

This problem is overcome in the present invention by causing the shunt devices to present an effective conductance at modulation frequencies proportional to the average current they pass. The supply voltage modulation at the output will then be proportional to the energizing current modulation at the input (across coil L), irrespective of the average level of the current. FIG. 5 shows the implementation of such improvement. In FIG. 5, the comparator and low-pass filter of FIG. 4 has been replaced by the combination of a voltage divider making up of resistors R6 and R7, a transconductor G, and capacitors C3 and C4.

The negative feedback loop that is formed by components R6, R7, G, C3, C4, M5, M11, M6 and M12 establishes the desired average supply voltage. Transient variation of this voltage, such as those due to the signal modulation, will produce a corresponding modulation in the current flowing through the active paths (M5 and M11, or M6 and M12) because of the capacitive feedback from the supply line O to the gates of transistors M5 and M6 through capacitor C4. As a result, the amplitude of the transient variations is reduced. Although the capacitive feedback produces an effective conductance between the supply lines that is related to the average current flow in the shunt paths, further means are needed to convert this relationship to a proportional one.

Figure 6:
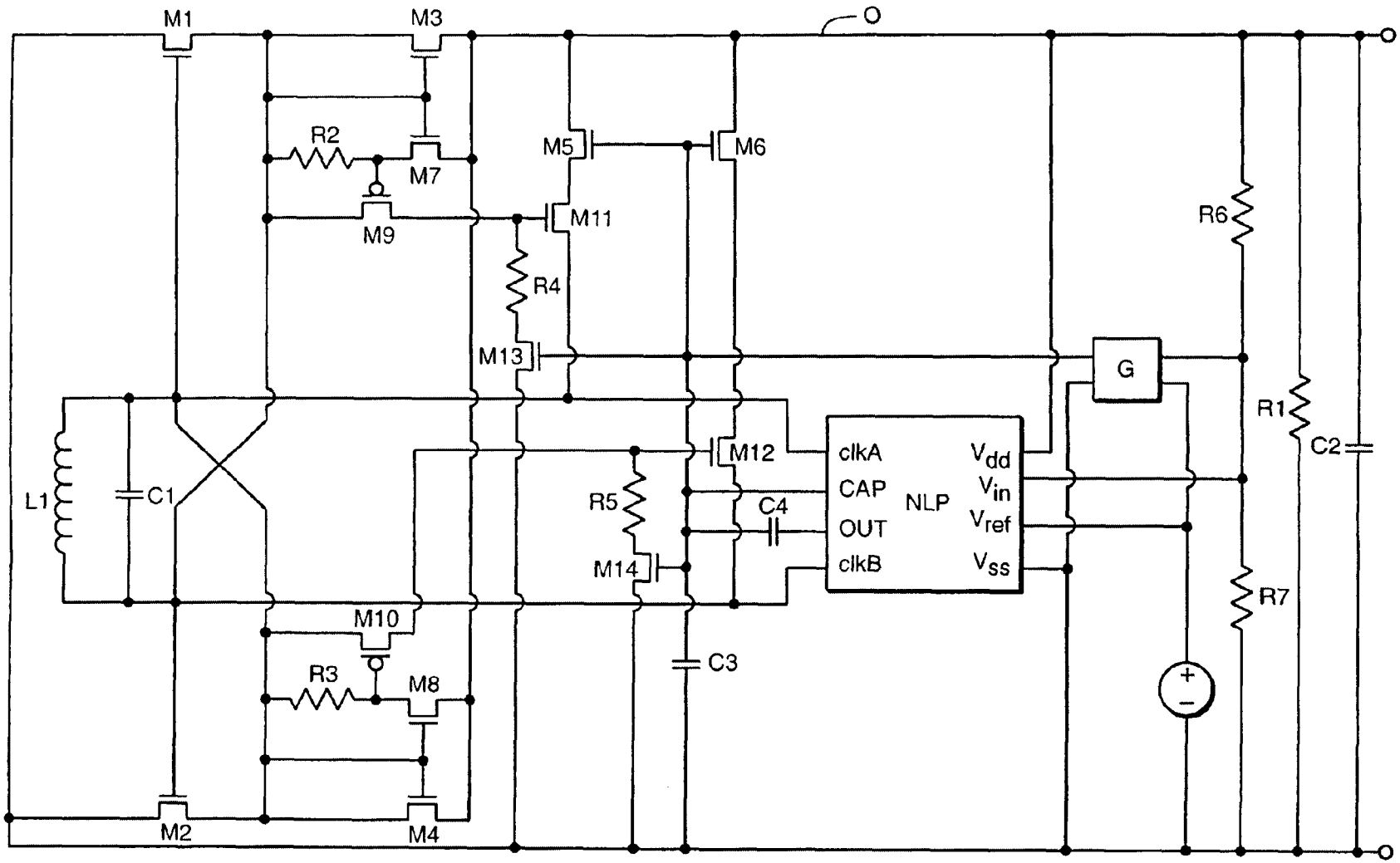
FIG. 6 is a schematic of the preferred embodiment of the shunt voltage regulator of the present invention.

FIG. 6 shows a preferred embodiment of the present invention that incorporates a non-linear processor NLP into the voltage regulator. The NLP has a first input terminal Vin that receives a voltage signal from the center tap of the voltage divider R6 and R7, a second input terminal Vref that receives a reference voltage signal, a third input terminal CAP that receives a signal from the output of the transconductor G, a first clock input terminal clkA, and a second clock input terminal clkB. An output terminal OUT of the NLP connects to a terminal of capacitor C4. The other terminal of the capacitor C4 connects to the controlling input of the shunt device and capacitor C3. The shunt device is regulated by two feedback pathways. A first feedback pathway makes up of the voltage divider R6 and R7, the transconductor G, and the capacitor C3. The first feedback pathway provides a low pass filtering function and it controls the average voltage. The NLP forms an integral part of a second feedback pathway. The NLP takes an input from the center tap of the voltage divider, an input from the reference voltage source and an input from the output of the transconductor G and outputs a controlling signal to the controlling input of the shunt device through the capacitor C4. The function of the NLP is to provide a proper proportionality between the modulation and the mean voltage. The non-linearity provided by the NLP in the second feedback pathway ensures that the regulator outputs a signal-band conductance that is proportional to the absorbed current.

Figure 7:
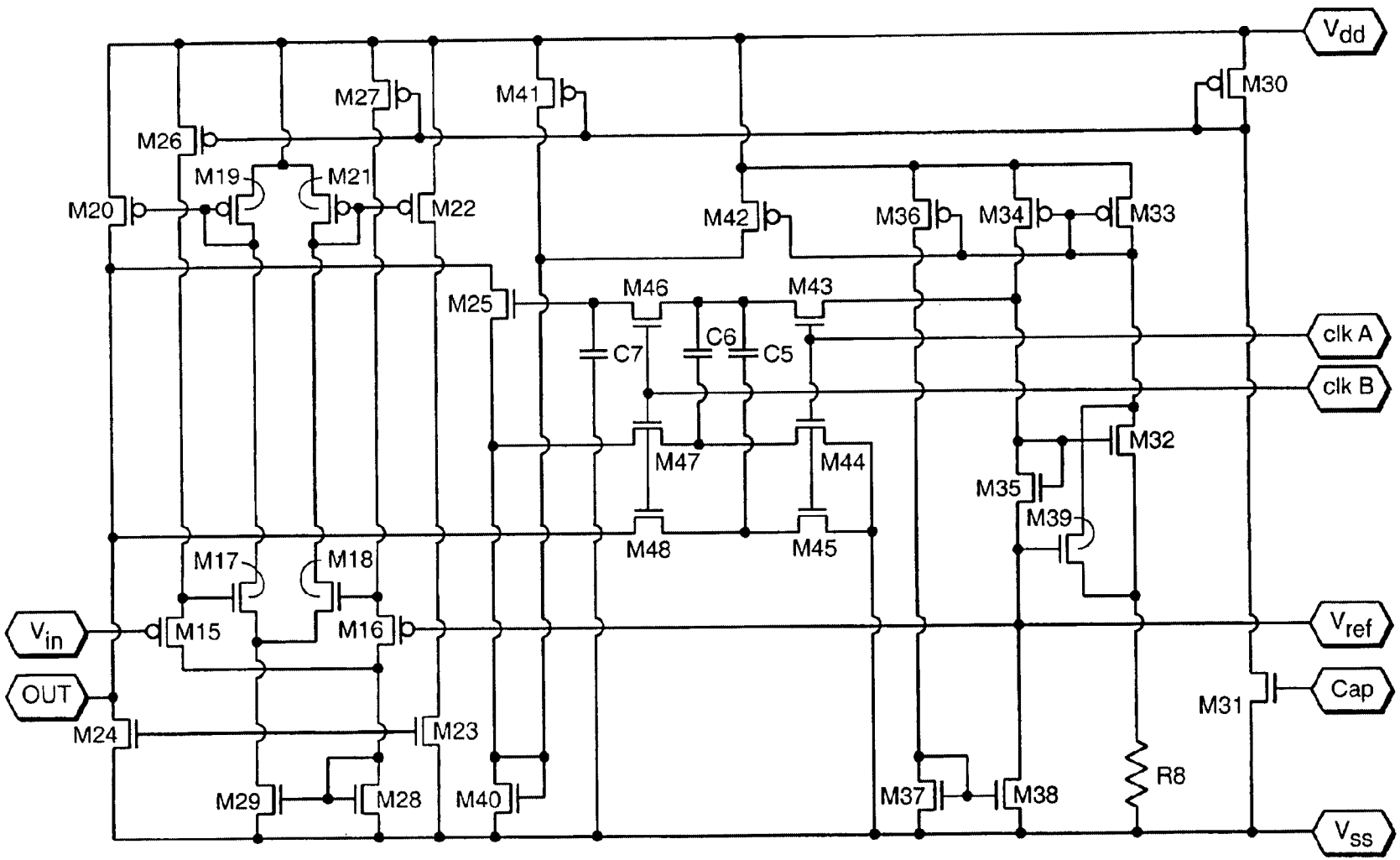
FIG. 7 is a schematic of non-linear processor according the present invention for use in the shunt voltage regulator of FIG. 6.

FIG. 7 shows a schematic of the non-linear processor NLP used in FIG. 6. In the figure, a balanced amplifier that is comprised of M15–M24 is responsive to the difference between an input voltage Vin provided by the voltage divider and the reference voltage Vref in FIG. 6. The output of the amplifier is connected to the drain of M25, which is a MOS device that is biased to operate as a resistor. The biasing current of the amplifier is set by M26 and M27, which feed current via M15 and M16 to a NMOS mirror formed by M28 and M29 and then to M17 and M18. The bias voltage applied to M26 and M27 is developed across M30, which is, in turn, biased by the current supplied by M31. The gate of M31 is connected to a NLP terminal that is labeled as CAP in FIG. 6, as well as the gates of the shunt devices M5 and M6 in FIG. 6. The biasing current is thus proportional to the current flowing in the active shunt device. MOS devices M32–M39 and resistor R8 provide a voltage at the drain of M35. M35 is operated at a very low current density and so its gate-source voltage approaches that of its threshold voltage. A feedback loop formed by M32–M35 constitutes a positive feedback loop and M39 provides the current to initiate it. Once initiated, M39 becomes non-conductive.

M25 acts as a resistance that presents an appropriate load coupled to the drains of M20 and M24. This resistance is returned to bias voltage established by M40, which, in turn, is biased by M41 and M42. The current passed by M41 tracks and exceeds the biasing current of the amplifier M15–M24 so that M40 can remain in conduction while absorbing positive and negative transient current feeding through M25 from the amplifier. However, these current transients tend to develop significant voltage transients across M40 when the biasing current that is established via M41 is very small. These voltage transients would add to those developed across M25, producing an error. It is M42's job to provide an additional small current to reduce the error.

For M25 to provide a symmetrical resistive characteristic, its gate must be biased at an appropriate quiescent level. Such bias voltage is established by the switched capacitor circuit that is comprised of MOS devices M43–M48, equal value capacitors C5, C6 and capacitor C7. When terminal clkA is high, M43–M45 become active and C5 and C6 are charged to the voltage at the drain of M35. When terminal clkB is high, M46–M48 become active. C5 is then connected between the gate and one channel terminal of M25 while C6 is connected between the gate and the other channel terminal. The gate voltage of M25, which is stored on C7 while M46–M48 are inactive, is thus made equal to the sum of three voltages: the reference voltage, the gate-source voltage of M35 and the mean channel voltage.

Other than a small error due to the body effect, the gate-source voltage of M35 matches the threshold voltage of M25. The resistance presented by M25 is thus symmetrical and it is defined by its geometry and the reference voltage. The geometry is chosen so that the time constant given by the product of the resistance and the capacitance provided by capacitor C4 is much less than the length of a modulation symbol.

From the forgoing description, it will be understood that the amplifier M15–M24 and the load device M25 provide a voltage gain that varies according to the square root of the current in the active shunt device and tracks the transconductance of the active device.

Since the amplifier responds to the difference between the voltage provided by the center tap of the voltage divider R6 and R7 of FIG. 6 and the reference voltage Vref, and that they have the same average value, it will be understood that the output voltage will be the supply voltage transients produced by the modulation multiplied by a gain which tracks the transconductance of the active regulator shunt device. This voltage is applied to the gates of the shunt devices through the capacitor C4 as it is shown in FIG. 6.

What is claimed is:

1. A voltage regulator circuit for a contactless smartcard that regulates an incoming inductively coupled and modulated signal comprising:

an inductor coil for converting an electromagnetic field into a current;

rectifying means connected to said inductor coil for converting said current to a rectified output voltage carrying a demodulated data signal;

a shunt device having at least one controllable conductive path for connecting the output of said rectifying means to ground, said shunt device diverting current from said output in accordance with control signals it receives at a controlling input, said controlling input being connected to a feedback path that is comprised of the following components:

a voltage dividing means for taking said output voltage from said rectifying means as an input and outputting a proportionally lowered voltage;

a low-pass filter means connected between the output of said voltage dividing means and said controlling input of said shunt device means for removing high frequency modulation components from the signal transmitted to said controlling input;

means for transmitting modulation of the data signal at the output of said rectifying means to the controlling input of said shunt device, thereby imposing a modulation on the shunt current that is proportional to the modulation of the output voltage of said rectifying means, and thereby maintaining the proportionality of the voltage variation at the output of the rectifier caused by the modulation; and a non-linear processing means having a first, second and third input connected to said voltage dividing means, a reference voltage means and a controlling electrode of said shunt device, respectively, said non-linear processing means generating a voltage proportional to the difference in voltage between the output of said voltage dividing means and said reference voltage wherein the proportionality is modified to compensate for the non-linear nature of the transconductance of the shunt device by modifying the bias conditions of the circuit;

the output voltage being further modified by a resistive means that compensates for the non-linear nature of the transconductance of the shunt device.

2. The voltage regulator circuit of claim 1, wherein said means for transmitting demodulation of the data signal is a capacitive means.

3. The voltage regulator of claim 1, wherein the non-linear processor comprises a balanced amplifier biased at a current proportional to that in said shunt device, and which takes a first input from the output of the voltage regulator and a second input from the reference voltage and outputs a current that is proportional to the difference in said voltage and to the square root of the bias current.

4. The voltage regulator of claim 3, wherein the balanced amplifier is connected to a resistive element, whereby an output voltage tracks the transconductance of the shunt device.

5. The voltage regulator of claim 1, wherein the shunt device includes a first pair of MOS transistors whose drains are connected to the output of the voltage regulator, whose gates are connected to the output of the low-pass filter means and the output of non-linear processing means, whose sources are connected to the induction coil through an second pair of MOS transistors.

6. The voltage regulator of claim 1, wherein the low-pass filter means is comprised of a transconductor with a first and second inputs and one output, the first input is connected to the output of the regulator while the second input is connected to the reference voltage source, the output is connected to the controller input of the shunt device.

* * * * *